United States Patent [19]

Burns

[11] 4,365,912

[45] Dec. 28, 1982

[54] TENSION LEG PLATFORM ASSEMBLY

[75] Inventor: Robert B. Burns, Huntington, N.Y.

[73] Assignee: Texaco Development Corporation, White Plains, N.Y.

[21] Appl. No.: 218,607

[22] Filed: Dec. 22, 1980

[51] Int. Cl.[3] ..... E02B 3/00; E02B 15/04

[52] U.S. Cl. ..... 405/60; 405/224

[58] Field of Search ..... 405/60, 195–209, 405/210, 224; 175/5–9; 169/69; 210/923

[56] References Cited

U.S. PATENT DOCUMENTS

| | | | |
|---|---|---|---|
| 1,830,061 | 11/1931 | Howe | 169/69 X |
| 3,548,605 | 12/1970 | Paull et al. | 405/60 |
| 3,664,136 | 5/1972 | Laval et al. | 405/60 |
| 4,037,424 | 7/1977 | Anders | 405/207 |

*Primary Examiner*—Dennis L. Taylor

*Attorney, Agent, or Firm*—Carl G. Ries; Robert A. Kulason; Robert B. Burns

[57] ABSTRACT

Tension leg platform system for use in drilling well bores into the floor of an offshore body of water. The system includes a buoyancy controlled vessel which is attached to anchors at the ocean floor by a series of pull down members. At the time of a well blowout, a detachably connected collar or anchor ring is guidably lowered from the vessel to the floor. Thereafter, a closure cap is drawn down to engage the anchor ring and thus permit escaping gas and crude oil to be directed through a conduit to the water's surface, where it can be collected.

10 Claims, 5 Drawing Figures

FIG. 2
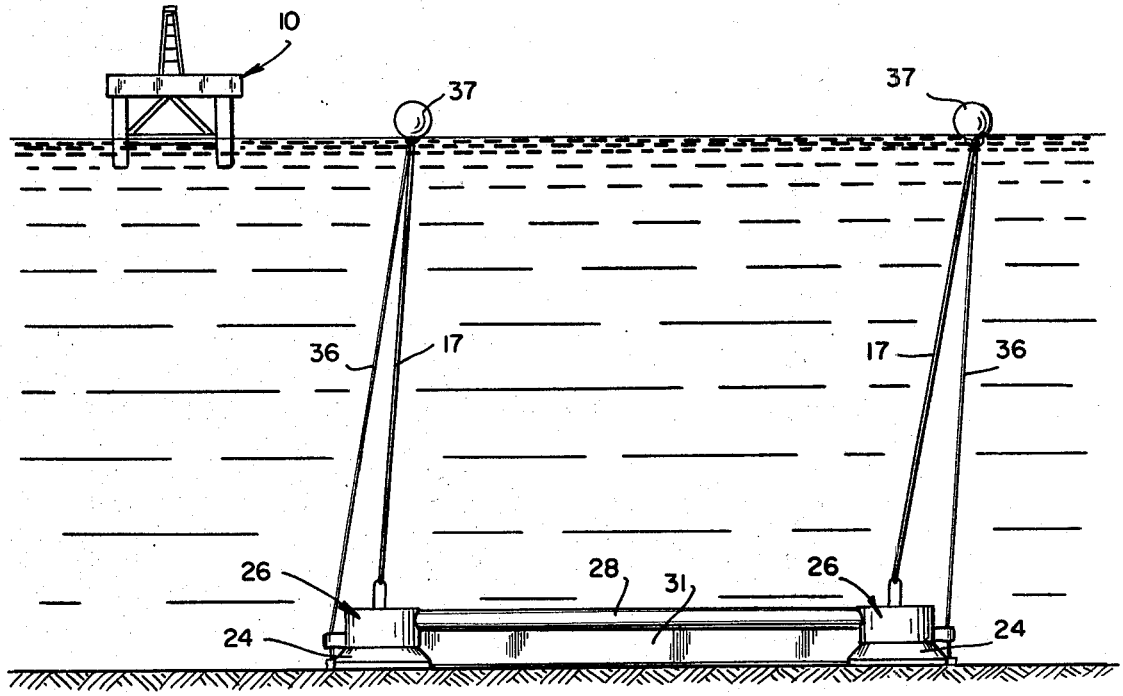
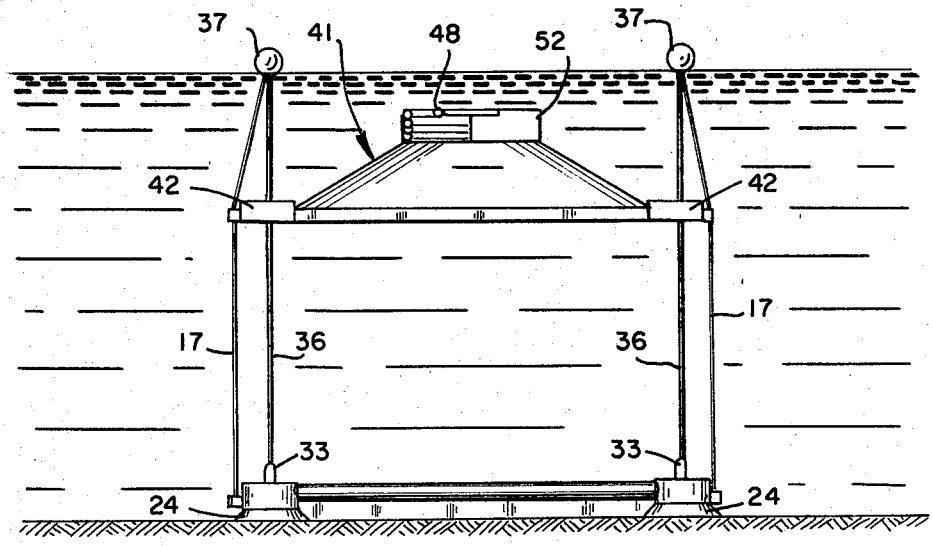
FIG. 3

FIG. 5
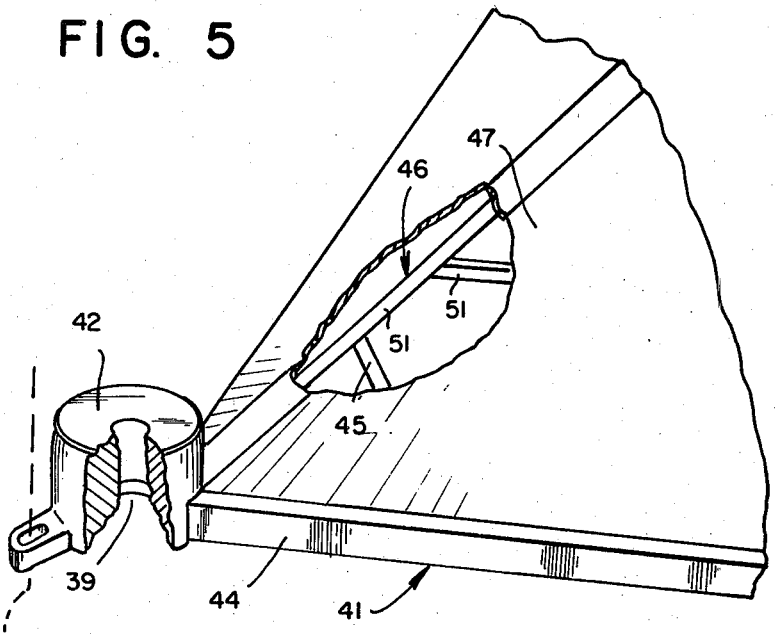
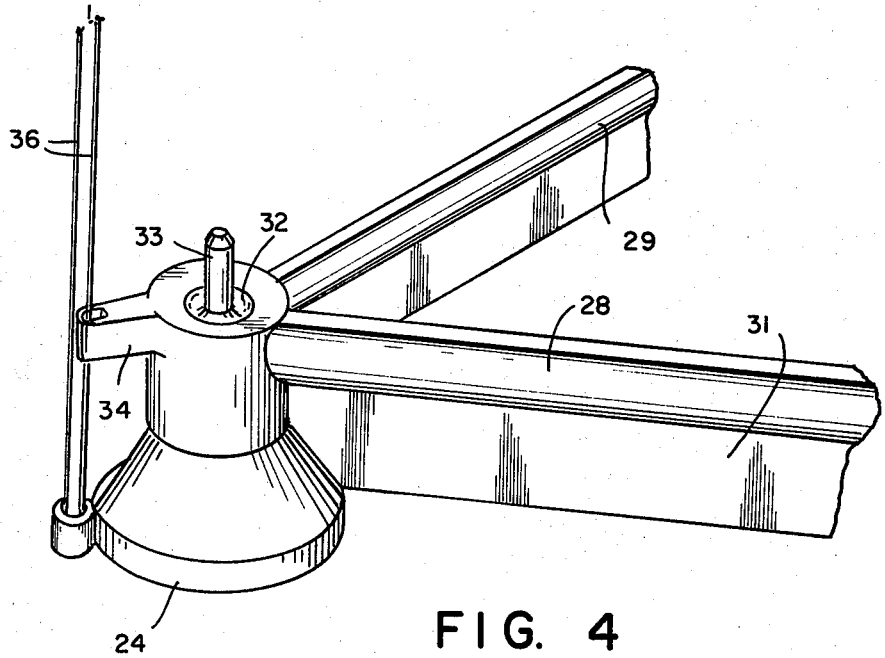
FIG. 4

TENSION LEG PLATFORM ASSEMBLY

BACKGROUND OF THE INVENTION

Technological and environmental problems have persistently arisen as the quest for crude oil and gas becomes more and more acute. Further, it has become necessary to go further offshore in search of adequate production areas. However, the further offshore that one goes, the deeper the water will be.

As a consequence, wellbores are being drilled regularly in greater than one thousand feet of water. While much technology is available regarding the safe and controlled drilling of offshore wells, the problems which arise in conjunction with the deeper waters are becoming increasingly complex.

With the greater depths of water in which it has become necessary to drill, fixed platforms utilized for producing such wells involves enormous costs. It thus reduces to a question of; is the prospective crude oil-containing reservoir beneath the ocean floor sufficiently abundant to warrant the use of expensive deep water drilling and/or producing platforms.

Within the past several years, considerable research and development work has been addressed toward the design and production of usable tension leg platform systems. In the latter type unit, the basic component comprises a floatable vessel which is capable of adjusting its buoyancy at the water's surface.

A plurality of anchors which have previously been positioned at the ocean floor, are connected to the buoyant vessel by a plurality of pull down cables or pipes. It is thus possible, by adjusting the tension on the pull down members, to position the floating vessel above an area in which a well is to be drilled.

The floating vessel will usually be displaced from directly above a drilling site by surface conditions such as wind and waves, as well as by underwater currents. It is nonetheless possible through the use of supported risers or the like to accomplish drilling operations at great water depths through this type of unit.

A problem which is always present when operating in deep offshore waters, is the possibility that the well or wells being drilled can at any time become uncontrolled or blown out and flow without restraint. This situation has occurred in the past and frequently results in loss of equipment due to damage and/or fire. It also results in the loss of the crude product and the gas, both of which flow rapidly to the water's surface.

With the added risk involved in drilling wells in deep waters, it is conceivable that even a minor leak at the ocean floor would permit an uncontrolled and disastrous flow of oil and gas. Such a situation would not only result in the loss of the oil, but could constitute a safety hazard to the immediate environment.

To overcome the above-identified problems and difficulties which are endemic to drilling in deep offshore waters, the present invention is provided. In the latter, a drilling vessel having a floatable hull is positioned at the water's surface upwardly, from a well site. Hold down, variable tension members operably connect to the vessel and extend downwardly to the ocean floor. At the latter the hold down members are connected to a plurality of prepositioned anchors.

A detachably connected ring or collar depends from the vessel's hull and includes means to operably engage the respective hold down members. Thus, in the event that an uncontrollably flowing well is encountered, the submergible ring can be slidably engaged with the hold down means and controllably lowered to the ocean floor. The vessel can then be removed from the area as a safety measure.

The ring includes means to engage the respective anchors, as well as the pull down cables. The ends of the latter are connected to buoys which float at the water's surface to locate the cable ends.

A cap member which defines a substantially fluid tight closure is then drawn by the pull down cables to engage the anchor ring. Uncontrollably escaping effluent can thus be confined, collected, and conducted to the water's surface.

It is therefore an object of the invention to provide an offshore well drilling and/or producing system which is capable of quickly and effectively confining the effluent from an uncontrollably flowing well. A further object is to provide a tension leg platform having means to collect the freely flowing effluent from an uncontrolled well at the ocean floor. A still further object is to provide a tension leg platform system having a detachably held, submergible ring that can be controllably lowered to the ocean floor by way of the platform's hold down means, whereby to receive a closure cap which will confine the well effluent.

DESCRIPTION OF THE DRAWINGS

FIG. 2 illustrates the system with the drilling vessel displaced.

FIG. 3 is similar to FIG. 2 showing the well cap at the water's surface.

FIG. 4 is an enlarged segmentary view showing the anchor ring in place.

FIG. 5 is an enlarged segmentary view of the cap member.

Figure 1:
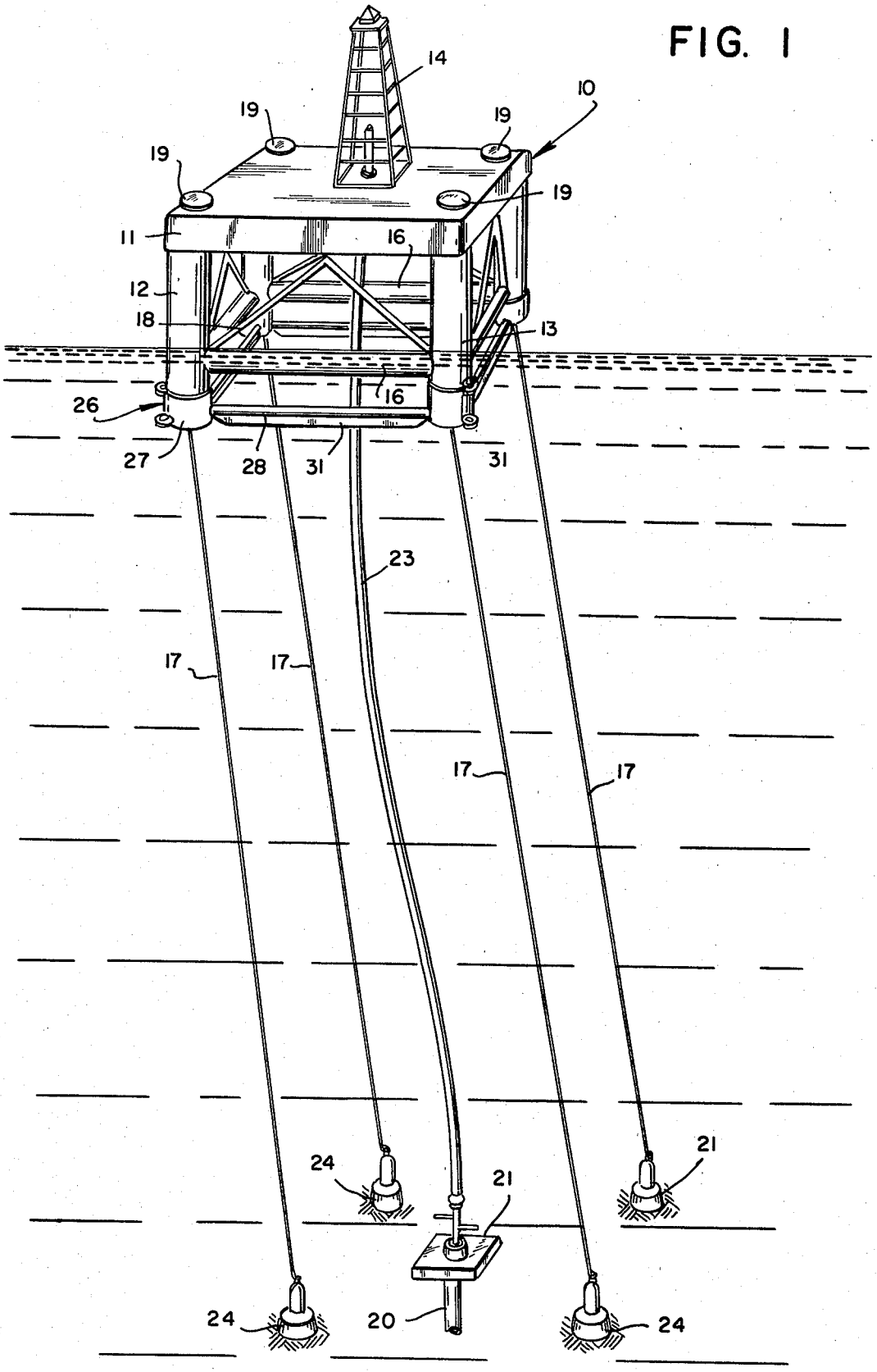
FIG. 1 is an environmental view of a tension leg platform system of the type contemplated.

Referring to the drawings, the present system is shown as embodying a tension leg marine vessel or platform 10 which is comprised of a deck 11 from which a plurality of support legs 12 and 13 downwardly depend. It is understood that the floating, or tension leg vessel is but one, albeit necessary element in the overall system. A single or multi-hull drilling vessel which utilizes the tension leg principle, can be adapted to the present system so long as it employs means to engage the various tensioning means which maintain it in position above a drilling site.

Referring to FIG. 1, vessel 10 is comprised primarily of raised deck 11. The latter supports the necessary equipment for achieving a drilling operation. Such equipment normally would be in the form of a derrick 14, together with the usual drill pipe storage areas, as well as means to accommodate operating personnel.

Deck 11 is preferably positioned a desired distance above the water's surface normally fifty or more feet to maintain the drilling equipment out of the reach of waves, ocean spray and the like. Thus, each platform 10 is provided as shown with a plurality of legs 12 and 13, which are judiciously disposed beneath deck 11 in a manner that they will furnish the necessary buoying support.

Each support leg is comprised essentially of an elongated cylindrical member which embodies internal buoyancy tanks. The tanks are in turn connected to pumping means located on deck 11 such that the buoyancy of the unit can be regulated and the deck levelled.

Controlled buoyancy vessels of this type are known in the art and have long been utilized in offshore operations.

Cross members 16 interconnect the various legs and are further equipped with tanks to regulate the buoyancy factor.

Thus, depending on the conditions under which platform 10 is operating, the buoyancy can be adjusted through operation of the platform's internal buoyancy control system. For example, when the platform is traveling between working sites, it normally floats under maximum buoyancy conditions at the water's surface. When, however, it is located at a drill site the platform will be buoyed to some degree. It will then be pulled down into the water counter to the buoyant force by the various hold down means such as pipes or cables 17.

To provide for lateral strength, the various support legs 12 and 13 can be provided with non-buoyant members 18 in a sufficient number to maintain the rigidity of the various legs with respect to deck 11.

A necessary characteristic of this type platform is the power winches or clamps 19 which accommodate the various hold down pipes or cables 17. Said winches 19 in the present instance are disposed adjacent the respective support legs 12 and 13. The winches are provided in sufficient number to assure that vessel 10 can be maintained at a desired disposition regardless of the condition of the weather at the water's surface.

The primary function of vessel 10 is to be maintained in position over a desired drilling site at the ocean floor. Thus, and as herein shown, a well 20 and well head 21 are illustrated, the latter of which embodies the usual blowout preventers and flow control equipment. Such well heads 21 together with their safety features, are normally provided in offshore underwater drilling operations.

In order that a rotating drill string might be lowered from derrick 14 to well head 21 to form a well bore, a riser 23 is provided. The latter extends from deck 11, downward through the water, being attached to the well head 21. Thus, the drill string, together with its flow of drilling mud, can be directed through riser 23 and into the substrate. The mud is then circulated back up through the riser and to a mud tank on deck 11.

Riser 23 normally comprises relatively heavy walled tubing which is of sufficient diameter to freely accommodate the rotating drill string therein. Further, riser 23 is preferably segmented such that it can be assembled at the drill site. To avoid excessive deformation due to water currents, riser 23 can be provided at different levels with lateral bracing which attaches to hold down means 17.

Each support leg 12 and 13, is provided as noted with a hold down arrangement in the form of cables or heavy wall tubing 17, which extends from the holding equipment 19 on deck 11 to anchor 24. The respective hold down pipes or cables are engaged at the lower ends by way of a suitable coupling, to the floor positioned, spaced apart anchors 24.

As vessel 10 is pulled progressively downward into the water, overcoming its own buoyancy by virtue of the tensioned hold down pipes 17, the vessel will become more closely aligned with well head 21 at the ocean floor. However, and as illustrated in the Figures, at greater water depths it is virtually impossible to have the vessel perfectly aligned above well head 21. Ocean currents and the conditions at the water's surface will usually displace vessel 10 and prohibit accurate alignment.

The respective hold down cable assemblies 17, are here illustrated as being a single cable, tube or pipe. Said hold down member can, however, be in the form of a plurality of cables which extend from each anchor and upward to a pulley or tensioning system at deck 11. In a similar manner, a pulley assembly can be provided at each anchor 24.

It has also been found desirable in some instances to utilize heavy walled pipe for the hold down or tension members. Thus, a series of pipe lengths are connected to form the desired length. The elongated pipe is then coupled at one end to an anchor 24 and at the other end to a clamping means 19 on deck 11.

To illustrate the invention, the hold down, tensioning means will be referred to as cables rather than pipes, although either embodiment will function as well.

Operationally, and as herein noted, marine vessel 10 is normally floated to a predetermined offshore drilling site either by towing, or under its own power. In the latter instance, the vessel, will be provided with propulsion units positioned at one or more of the various legs.

At the desired drilling site, anchors 24 which have been, or will be positioned at the ocean floor, are disposed in such manner as to align approximately with the various platform support legs. It is appreciated that such alignment might be inaccurate; however, the pull down function of the cables 17 will nonetheless be effective so long as tension can be applied uniformly to the various legs 12 and 13.

With platform 10 approximately positioned over a drilling site, buoyancy of the respective support legs is adjusted such that the platform will float relatively high in the water. Thereafter, tension is applied to each of the hold down cable assembles 17 such that the platform will gradually be pulled downward into the water. It will thus be moved more to a vertical position above the various anchors and consequently be substantially fixed above the prospective drilling location.

After wellhead 21 has been installed, riser 23 will likewise be connected between wellhead 21 and the platform 10 to receive a lowering drill string. The procedure as herein described is standard for tension leg type platforms and will permit the lowering drill string to be guided to the ocean floor and form a well bore 20.

In accordance with the invention, drilled vessel 10 is provided at its underside with detachably connected anchor ring or collar 26. The latter depends from the underside of vessel 10, preferably arranged to cooperate with the respective vessel legs 12 and 13 when a semi-submersible type of vessel is utilized.

Under normal operating conditions, collar 26 is submerged and thus can be an integral part of the vessel's buoyancy control system.

Collar 26 is primarily an open structured member formed with corner blocks 27. The latter, when in the connected position, are disposed substantially in alignment with the vessel's respective support legs 12 and 13. Corner blocks 27 are mutually connected by a series of transverse members 28 and 29. The latter can also be provided with internal buoyancy means.

The transverse members are preferably formed of cylindrical elements which are end welded to respective corner blocks 27. While not shown, said corner members are provided with internal ballast tanks, and with connections for communicating the various tanks to a source of water and compressed air whereby the buoyancy can be adjusted by ballasting as required.

The underside of each transverse member 28 and 29 is provided with a skirt-like arrangement 31. The latter depends downwardly from the transverse member such that as the latter approaches the ocean floor, the skirt lower edge will come to rest on the floor, or make entry thereinto. The collar 26 will thus form a substantially fluid tight seal with the ocean floor about well 20.

The structure of collar 26 is such that it is basically open. It will therefore be subject to a minimal disturbance due to water turbulence during a descent to the ocean floor.

Collar corner blocks 27 are provided as shown with a central docking slot 32. The latter is arranged to be slidably registered on and fixed to the upright guide column 33 of anchor 24 when the collar is lowered to the ocean floor.

The primary function of collar 26 is to be detached from vessel 10 at such time as an emergency situation arises as where there is a well blowout or fracture at the ocean floor. In such an instance, collar 26 is detachably released from the underside of vessel 10 and guidably lowered by way of cable means 17 through the turbulence, and to the ocean floor. In that collar 26 has its own internal buoyancy, it can be water ballasted. Thus the collar will descend to the ocean floor and be controlled in a manner that it will be guided onto and engage the respective positioning anchors 24.

During an emergency operation as when the well is blown out such that a stream of fluid effluent emerges under pressure in the form of crude oil and gas, water beneath the vessel 10 will be severely disturbed. This will be particularly true in the instance of gases which leave the well under pressure and rapidly expand as gas bubbles rise to the surface. It is understandable then that such a condition causes a highly disturbed atmosphere in the water by the time the bubbles reach the surface. Further as they arrive at the surface and burst, the atmosphere created at the water's surface will be hazardous.

Since it would be difficult to lower collar 26 or any object, through the disturbed and turbulent water conditions, the collar is primarily open structured, being formed as noted with the respective corner blocks 27, and peripheral connecting members. The latter, however, can be reinforced by necessary structural elements to avoid undue strain on the collar as the latter attempts passage through the gas created turbulence.

To further assure collar 26 being properly guided to the ocean floor, it is provided with means such as a cable gripping arrangement 34. Collar 26 can thus be positively lowered as soon as it is detached from the underside of vessel 10. Said cable gripping means can attach as needed to either hold down means 17, or to a separate tether line 36.

In the instance of the latter, tether lines 36 extend from vessel 10 downwardly to anchor 24 in a closed loop. By applying tension to a branch of the loop at each anchor, collar 26 can be uniformly drawn down as to be simultaneously registered on the respective anchors 24.

With collar 26 in position at wellhead 21, the hold down cables 17 can be released and the vessel 10 unmoored. The latter can then be relocated at a safe distance beyond the turbulent water environment.

Prior to being released, each of the hold down cables 17 is fastened at its upper end to a float or buoying means 37. The latter is of sufficient size and capability to maintain the cable in a substantially upright position even through the float be subjected to wind and wave movement at the water's surface. Preferably, each hold down cable 17 is connected to a single float. Each of the latter can thereafter be further connected one to the other through a common cable, thus simplifying retrieval of the floats.

To confine uncontrolled effluent flow from the ocean floor, cap 41 is provided which embodies a partial closure. Cap 41 is formed primarily of a series of corner posts 42 which are spaced preferably to correspond with corner blocks 27 on collar 26.

Each cap corner post 42 is further provided with aligning means such as a lower cavity 29 for registering the corner post with the upright section 33 of anchor 24. After being brought into contact, the collar and cap can be properly aligned through mutual guide means, and joined at the ocean floor into a single unit.

Cap 41 is provided with a plurality of foundation members 44, which are in turn reinforced by intermediate members 45 as required to form the unit into a relatively rigid and durable structure.

The reguirement for both strength and resilience in cap 41 is necessary since the cap will be subject to considerable stress and strain as it passes downwardly through the turbulent water. This abuse is to be expected since the cap is provided with a superstructure 46 onto which closure members 47 are supportably mounted. Thus, bubbles which rise beneath the enclosure will tend to toss the cap about in spite of the confining guide cables.

Superstructure 46 can in one embodiment assume the form of a series of support arms 51 which extend upwardly from foundation members 44. They are preferably arranged to converge inwardly and terminate at their upper end in a connector ring 48. Closure 47 is preferably formed of sheet metal plates 49 which are fastened to the respective support beams 51 at substantially fluid tight seams to define a converging fluid closure which terminates at the upper opening defined by ring 48.

Cap 41 need not be kept in the vicinity of drilling vessel 10 but rather is kept available for use by a number of vessels. To position cap 41 in registry with the previously positioned collar 26, the cap is towed or floated into position above well 20 by virtue of the cap's buoyancy.

For a lowering operation, cap 41 is at least partially ballasted to overcome its buoyancy. Thus, the cap will offer a minimum degree of resistance to being drawn to the ocean floor. However, the unit's submerged condition will not be such as to cause it to rapidly descend to the ocean floor with the possibility of becoming misaligned in doing so.

To assure the necessary alignment with collar 26, cap 41 is operably engaged to tether lines 36 which previously guided collar 26 to its floor mounted position. Alternately, the cap can be positioned to engage the float supported guide cables 17. Thus by controllably lowering the cap through use of tether lines 36, the cap will be controllably drawn to the ocean floor in spite of extreme turbulence caused by expanding gas and upwardly flowing crude oil. Without proper guidance, the cap 41 would ordinarily uncontrollably be unmanageable.

Cap 41 is further provided with a conduit 52 in the form of a flexible, tubular conducting member. The latter, during the cap lowering operation, is folded into a compact package having its lower end connected to the cap's upper ring 48. Thus, as cap 41 is drawn down to its floor position into engagement with the previously positioned collar 26, the conduit will remain retracted. The two members i.e. cap 41 and ring 26, are provided with automatic or remotely controlled locking means. Thus as they come into contact, the cap and ring will be maintained locked by a positive connection.

With cap 41 properly locked into position, the rising effluent will pass from the fractured well and flow upwardly through the enclosure and into discharge opening 48. Thereafter, flexible conduit 52 can be released from its compacted position and permitted to rise to the water's surface.

This rising action is readily achieved by providing the upper end of conduit 52 with buoyancy means such that it will raise itself to the water's surface. When conduit 52 reaches the latter, it is retrieved and because of its flexibility, can be positioned such that the upper end is out of the turbulent area.

With cap 41 in position, it can be appreciated that the amount of gas and oil flowing from well 20 will be completely confined within conduit 52. This effluent control will permit the water in the area of well 20 to remain sufficiently placid that vessels can be moved into the area whereby escaping gas and crude flow can be collected.

The crude oil product will usually be pumped into a barge or storage means, and the gas collected into a vessel. Better still, the gas will be passed directly ashore through a pipeline or similar means.

With the flow of effluent from the well controlled, well 20 can be closed in by an intercepting well or by means normally pursued for capping an uncontrolled flow. In any event, during the operation there will be little if any loss of the effluent.

The provision of the present arrangement which permits vessel 10 to be moved from its point of danger prior to the well closing operation has several advantages. The primary consideration is the safety of the vessel and of the personnel involved. Both will be removed from the immediate vicinity which, because of the presence of the gas, will constitute a safety hazard. Further, any pollution of either air or water due to the presence of gas or crude oil will be substantially avoided since the effluent will be collected.

At such time as the uncontrolled well has been plugged, capped or in other ways prohibited from further discharge, vessel 10 can be returned to continue its drilling operation. This is achieved by reversing the order in which cap 41 and collar 26 were lowered to the ocean floor.

Notably, first cap 41 is retrieved to the surface through control of its buoyancy and the guidance of tether line 36. Thereafter, cap 41 can be cleared of its tether lines 36 and floated out of position.

Collar 26 can likewise be raised to the water's surface. The collar can now be reattached and maintained beneath vessel 10 in anticipation of another blowout at the ocean floor.

Other modifications and variations of the invention as hereinbefore set forth can be made without departing from the spirit and scope thereof, and therefore, only such limitations should be imposed as are indicated in the appended claims.

We claim:

1. The combination with a tension leg marine structure adapted for drilling a well bore into the ocean floor at a drilling site in an offshore body of water, and including;

a vessel having a buoyancy controlled hull, a plurality of anchors positioned at the ocean floor in said body of water and spaced about said well bore, hold down tensioning means extending between and detachably connecting said vessel hull with the respective plurality of anchors, to maintain the vessel in substantially vertical alignment with the well bore, of a collar detachably depending from the hull and having guide means thereon adapted to slidably engage the hold down tensioning means, whereby said collar can be detached from the hull and controllably lowered to engage said anchors at the ocean floor and surround a well bore from which an uncontrolled stream of effluent fluid is flowing, a cap having an enclosure thereon, which cap is adapted to be guidably lowered to the ocean floor and fixedly engage said collar, whereby to align said enclosure above said well bore thus confining said uncontrollably flowing effluent fluid stream.

2. In the system as defined in claim 1, including;

float means adapted to engage the upper ends of the respective hold down tensioning means to permit detachment of the tensioning means from the vessel, and displacement of the latter from the drill site.

3. In the system as defined in claim 1, wherein said collar includes;

controlled buoyancy means being adjustable to regulate the collar buoyancy while attached to the vessel hull and subsequent to being detached from the latter.

4. In the system as defined in claim 1, wherein said collar includes;

ballast tanks carried therein, and means communicating the respective ballast tanks to a source of compressed air and to a source of water, whereby to permit remote controlled regulation of the collar's buoyancy.

5. In the system as defined in claim 1, wherein said collar includes;

a plurality of corner members, and connector elements being disposed peripherally thereabout engaging the respective corner members, to afford the collar a substantially unoccupied interior defined by said connector elements.

6. In the system as defined in claim 1, wherein said collar includes;

docking means which is adapted to register with and engage the respective anchors.

7. In the system as defined in claim 6, wherein said docking means includes; a docking cavity formed in the corner members.

8. In the system as defined in claim 1, including;

a skirt member depending downwardly from said collar to engage and form a substantial seal with the ocean floor when the collar is lowered to the latter.

9. In the system as defined in claim 5, including;

a skirt depending downwardly from the peripherally arranged connector elements to engage the ocean floor in a peripheral seal when the collar is lowered thereto.

10. In the system as defined in claim 1, wherein the anchor means includes;

an upwardly extending upright portion, and said collar includes means forming a downward docking cavity which is adapted to slidably engage and register with said anchor upright portion, whereby to fixedly position the collar with respect to the respective anchors.

* * * * *